US007766079B2

(12) United States Patent
Hoffarth

(10) Patent No.: US 7,766,079 B2
(45) Date of Patent: Aug. 3, 2010

(54) PUMPING INSTALLATION FOR A GAS PRODUCING WELL

(75) Inventor: Clayton Hoffarth, Breton (CA)

(73) Assignee: Global Energy Services Ltd., Calgary (CA)

( * ) Notice: Subject to any disclaimer, the term of this patent is extended or adjusted under 35 U.S.C. 154(b) by 46 days.

(21) Appl. No.: 12/121,472

(22) Filed: May 15, 2008

(65) Prior Publication Data

US 2008/0308265 A1 Dec. 18, 2008

(51) Int. Cl.
*E21B 43/00* (2006.01)
*F04B 17/00* (2006.01)

(52) U.S. Cl. ..... 166/68.5; 417/382; 417/904

(58) Field of Classification Search ..... 166/67, 166/68.5, 105, 370; 417/904, 382, 390; 60/484
See application file for complete search history.

(56) References Cited

U.S. PATENT DOCUMENTS 2,467,398 A 4/1949 Miller
3,005,413 A * 10/1961 Coberly ..... 166/52
5,226,294 A 7/1993 Mayer

FOREIGN PATENT DOCUMENTS

CA 2432124 A1 12/2004
WO 9733070 A2 9/1997

* cited by examiner

*Primary Examiner*—David J Bagnell
*Assistant Examiner*—Catherine Loikith
(74) *Attorney, Agent, or Firm*—Christensen O'Connor Johnson Kindness PLLC

(57) ABSTRACT

A pumping installation for a gas producing well. A gas compressor is positioned on surface which receives gas. The compressor is powered by hydraulic fluid. An engine is positioned a sufficient distance from the gas producing well as not to pose a danger of gas explosion. A hydraulic reservoir is provided. Hydraulic fluid is circulated by the engine to supply hydraulic fluid from the hydraulic reservoir needed to power the compressor.

2 Claims, 1 Drawing Sheet

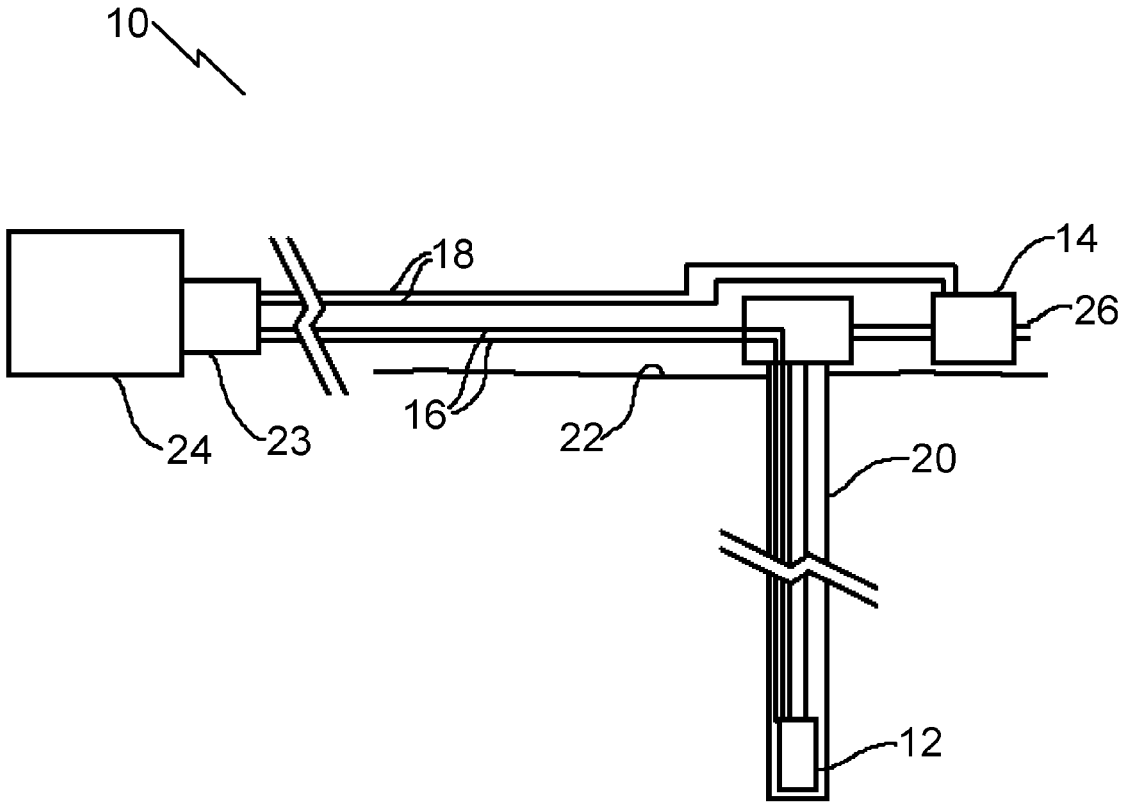
THE FIGURE

PUMPING INSTALLATION FOR A GAS PRODUCING WELL

FIELD

The present invention relates to pumping installation for a gas producing well.

BACKGROUND

Canadian Patent 2,432,124 (Hoffarth) is an example of a hydraulic pumping unit.

SUMMARY

There is provided a pumping installation for a gas producing well. A gas compressor is positioned on surface which receives gas flowing to surface. The compressor is powered by hydraulic fluid. Means are provided for storing or transporting compressed gas received from the compressor. An engine is positioned a sufficient distance from the gas producing well as not to pose a danger of gas explosion. A hydraulic reservoir is provided. Hydraulic fluid is circulated by the engine to supply hydraulic fluid from the hydraulic reservoir needed to power the compressor.

BRIEF DESCRIPTION OF THE DRAWINGS

These and other features will become more apparent from the following description in which reference is made to the appended drawings, the drawings are for the purpose of illustration only and are not intended to in any way limit the scope of the invention to the particular embodiment or embodiments shown, wherein:

THE FIGURE is a schematic layout of a pumping installation for a gas producing well.

DETAILED DESCRIPTION

A pumping installation generally identified by reference numeral 10, will now be described with reference to THE FIGURE.

Structure and Relationship of Parts:

Pumping installation 10 has a pump 12 and a gas compressor 14 that are each powered by hydraulic fluid. Hydraulic fluid flows to pump 12 through lines 16, and to compressor 14 through lines 18. Pump 12 is positioned in a gas producing well 20, while gas compressor 14 is positioned on surface 22, and receives gas pumped to surface by pump 12. Gas compressor 14 may be, for example, a rotary or reciprocating-type compressor. The hydraulic fluid is circulated through lines 18 and 16 from a hydraulic reservoir 23. The hydraulic fluid is circulated by an engine 24 to supply hydraulic fluid from hydraulic reservoir 23 that is needed to power both pump 12 and compressor 14. Lines 18 and 16 allow engine 24 to be positioned a sufficient distance from gas producing well 20 so as not to pose a danger of gas explosion. Gas compressor 14 has an outlet 26, which may be connected to either a storage or transport facility (not shown) to store or transport the compressed gas exiting compressor 14.

Operation:

Pumping installation 10 is installed as shown in THE FIGURE, with pump 12 positioned downhole within gas producing well 20, and compressor 14 is positioned on surface 22 at the outlet of well 20. Engine is positioned at a sufficient distance from well 20 to reduce the risk of explosion from a gas leak, and circulates hydraulic fluid from hydraulic reservoir 23 through hydraulic lines 16 to power downhole pump 12, and through hydraulic lines 18 to power gas compressor 14. As compressor 14 compresses the produced gas, it exits outlet 26, and is carried to either a storage or transport facility.

Advantages:

The pumping installation described above provides a number of advantages:

- The engine is positioned at a distance from the gas producing well, avoiding any potential danger of ignited gas.
- The engine does not have to be explosion proof.
- Having the engine positioned at a distance reduces the "footprint" left by equipment surrounding the well.
- A single engine circulates hydraulic fluid to power both the pump and the compressor, eliminating the need for a second drive system.
- The system can be operated with reduced pressure (perhaps as low as 5 pounds per square inch) which reduces back pressure and potentially increases inflow performance.

Variations:

- In the preferred embodiment both a pump and a compressor are operated by hydraulic fluid circulated by the engine. It will be appreciated that in wells with different pumping configurations there may not be a need to power the engine with hydraulic fluid. In such installations, the compressor alone is powered by the hydraulic fluid provided by the engine.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiments without departing from scope of the Claims.

What is claimed is:

1. A pumping installation for a gas producing well, comprising:

a gas compressor positioned on surface which receives gas pumped to surface by a pump, the compressor being powered by hydraulic fluid;

means for storing or transporting compressed gas received from the compressor;

an engine positioned a sufficient distance from the gas producing well as not to pose a danger of gas explosion; and a hydraulic reservoir, hydraulic fluid being circulated by the engine to supply hydraulic fluid from the hydraulic reservoir needed to power the compressor.

2. The pumping installation of claim 1, wherein the pump is positioned in the well, the pump being powered by hydraulic fluid, hydraulic fluid being circulated by the engine to supply hydraulic fluid from the hydraulic reservoir needed to power both the pump and the compressor.

* * * * *

UNITED STATES PATENT AND TRADEMARK OFFICE

CERTIFICATE OF CORRECTION

PATENT NO. : 7,766,079 B2
APPLICATION NO. : 12/121472
DATED : August 3, 2010
INVENTOR(S) : C. Hoffarth It is certified that error appears in the above-identified patent and that said Letters Patent is hereby corrected as shown below:

Title Page

| COLUMN | LINE | ERROR |
|---|---|---|
| (30) Pg. 1, col. 1 | Foreign Application Priority Data | Before the line beginning with "(51) Inc. Cl." please insert --(30) Foreign Application Priority Data June 18, 2007 Canada 2599447-- |

Signed and Sealed this

Twelfth Day of October, 2010

David J. Kappos

David J. Kappos
*Director of the United States Patent and Trademark Office*